US005163251A

United States Patent [19]

Lee

[11] Patent Number: 5,163,251

[45] Date of Patent: Nov. 17, 1992

[54] HAND-HELD KNIFE SHARPENER

[76] Inventor: David Lee, 6F-1, 49, Sec. 2, Chang An E. Rd., Taipei, Taiwan

[21] Appl. No.: 733,336

[22] Filed: Jul. 22, 1991

[51] Int. Cl.[5] ..... B24D 5/00

[52] U.S. Cl. ..... 51/214; 51/211 R; 51/181 R; 76/82; 76/86; 76/88

[58] Field of Search ..... 51/181 R, 205 WG, 211 R, 51/214; 76/86, 88, 82, 82.1, 82.2, 83

[56] References Cited

U.S. PATENT DOCUMENTS

| | | | |
|---|---|---|---|
| 4,494,340 | 1/1985 | Carter | 51/214 |
| 4,502,254 | 3/1985 | Carter | 51/214 |
| 4,530,188 | 7/1985 | Graves | 52/214 |
| 4,731,957 | 3/1988 | Weisinger | 51/205 WG |
| 4,751,795 | 6/1988 | Jenne | 51/205 WG |

*Primary Examiner*—Bruce M. Kisliuk
*Assistant Examiner*—Bo Bounkong
*Attorney, Agent, or Firm*—Frank B. Robb

[57] ABSTRACT

A handy knife sharpener comprising two symmetric side frames connected together to hold two crossed abrasive rods therein for sharpening cutting tools, wherein the peripheral edge thereof comprises a hand-hold portion at one end for comfortable and positive grip, a bevel slot at the top for supporting and guiding the knife to be sharpened, a sloping surface portion at an opposite end at right angle relative to said bevel slot for stopping against the ground of a work table. The position of each abrasive rod can be changed once it is worn at a fixed area on the peripheral grinding surface thereof.

2 Claims, 4 Drawing Sheets

HAND-HELD KNIFE SHARPENER

BACKGROUND OF THE INVENTION (a) Field of the Invention

The present invention relates to a hand-held knife sharpener and relates more particularly to such a hand-held knife sharpener having two crossed abrasive rods fastened in a bevel slot on the peripheral edge of the housing thereof which is formed of two symmetrical side frames. Through the bevel slot, cutting tool is inserted in the housing and sharpened by the abrasive rods. An additional abrasive rod is fastened inside the housing above a notch on the bottom edge thereof for removing the burr from the sharp edge of a cutting tool.

(b) Description of the Prior Art

According to conventional method, a grinding stone or a motorized grinder may be used when a knife needs sharpening. Using a grinding stone to sharpen a knife may injure one's hand or fingers easily. A motorized grinder is generally expensive not suitable for personal or family use. Further, a motorized grinder occupies much space to install. In U.S. Pat. No. 4,751,795, there is disclosed a manual knife sharpener which is generally comprises of a handle having two abrasive rods fastened therein at one end which abrasive rods are crossed over each other. This knife sharpener is provided with a knife blade alignment side and supporting surface edge guides. This structure of knife sharpener is not convenient to carry because the crossed abrasive rods are disposed at the outside. It is also not safe in operation because the sharp edge of the knife under grinding is continuously moved back and forth in the direction directly toward the operator. Further, the two crossed abrasive rods are fixedly fastened in the handle and only a limited surface area is provided for grinding, and therefore, the service life of the sharpener is relatively shortened.

SUMMARY OF THE INVENTION

The present invention has been accomplished to eliminate the aforesaid problems. According to one aspect of the present invention, there is provided a hand-held knife sharpener which comprises two crossed abrasive rods fastened in a bevel slot on the peripheral edge of the housing thereof which is formed of two symmetrical side frames. Through the bevel slot, cutting tool is inserted in the housing and sharpened by the abrasive rods. The position of each abrasive rod can be changed once it is worn at a fixed area on the peripheral grinding surface thereof.

According to another aspect of the present invention, the hand-held knife sharpener has an orthopedically engineered housing formed of two symmetric side frames which has a bevel slot for supporting and guiding the knife to be sharpened, permitting the sharp edge of the knife to be constantly disposed downwards outwards relative to the operator.

According to still another aspect of the present invention, the hand-held knife sharpener has a sloping surface portion at the front end thereof disposed at right angle relative to the bevel slot into which the knife to be sharpened is inserted, which sloping surface portion can be stopped against the ground or the top edge of a work table to facilitate knife sharpening operation.

According to a yet further aspect of the present invention, the hand-held knife sharpener has a notch at the bottom and an additional abrasive rod disposed above said notch and provided for removing the burr from the sharp edge of a cutting tool.

DETAILED DESCRIPTION OF THE PREFERRED EMBODIMENT

Figure 1:
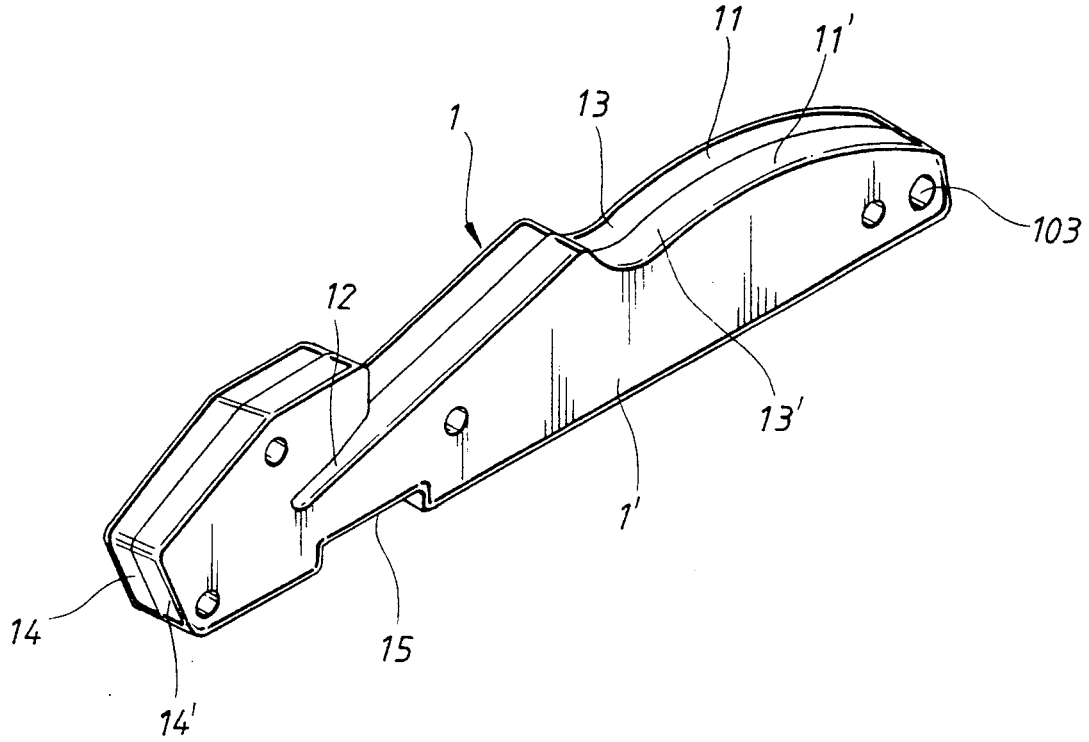
FIG. 1 is a perspective assembly view of the preferred embodiment of the hand-held knife sharpener of the present invention.
Figure 2:
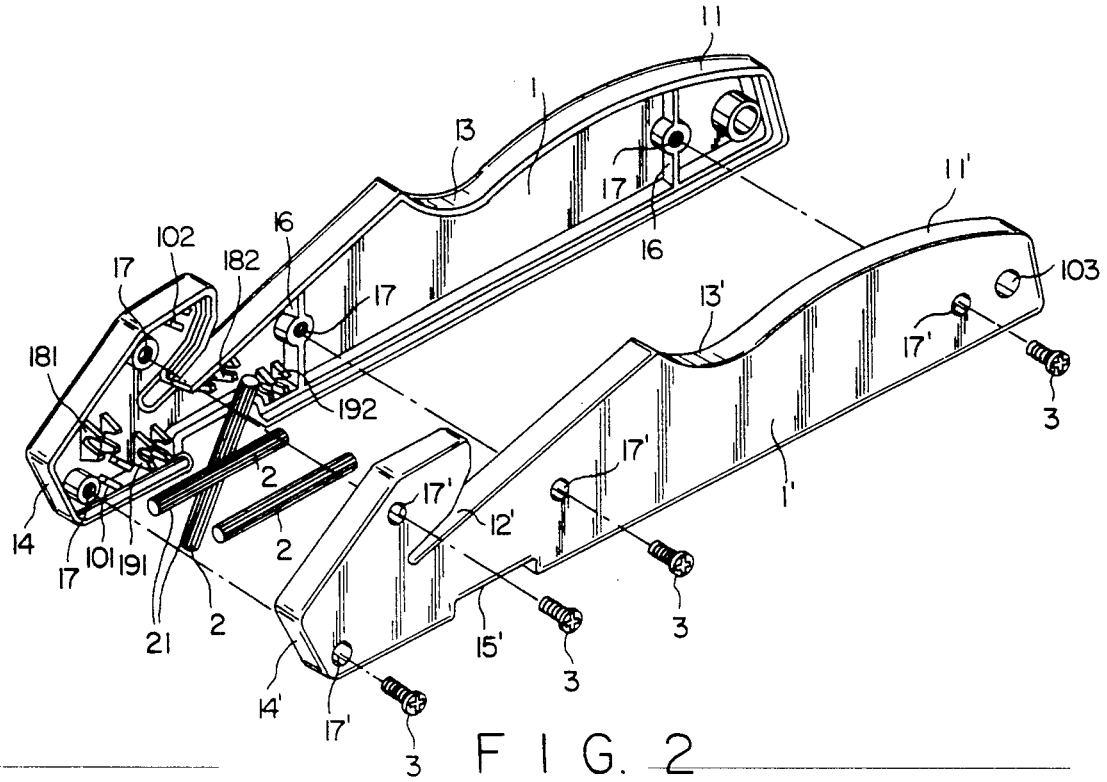
FIG. 2 is an exploded perspective view thereof.

Referring to FIGS. 1 and 2, therein illustrates is the preferred embodiment of the hand-held knife sharpener of the present invention which is generally comprised of two symmetrical side frames 1 and 1' and a plurality of abrasive rods 2. The two symmetrical side frames 1 and 1' are connected together to hold the abrasive rods 2 therein, rods 2 are fastened inside.

As illustrated, the side frames 1 and 1' are symmetrical, each of which having a peripheral edge 11 or 11' at right angle connected to each other. By connecting the peripheral edge 11 of the first side frame 1 to the peripheral edge 11' of the second side frame 1', the first and second side frames 1 and 1' are incorporated into a handle-like structure. The peripheral edge 11 (11') is formed into a bevel slot 12 (12') and a curved surface portion 13 (13') at the top, a sloping surface portion 14 (14') at one end at right angle relative to said bevel slot 12 (12'), and a notch 15 (15') at the bottom. The side frame 1 (1') further comprises a plurality of reinforcing ribs 16 (16') and bolt holes 17 (17'). The bolt holes 17 on the first side frame 1 are respectively aligned with the bolt holes 17' on the second side frame 1' and then fixedly secured in place by screws 3.

Figure 3:
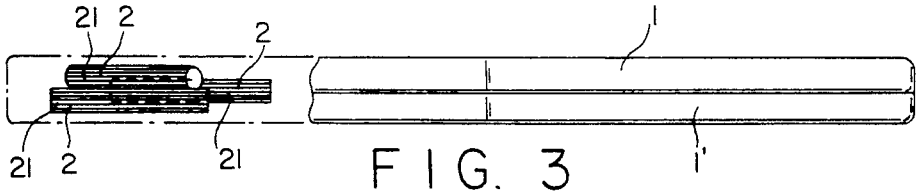
FIG. 3 is a sectional top view thereof.
Figure 4:
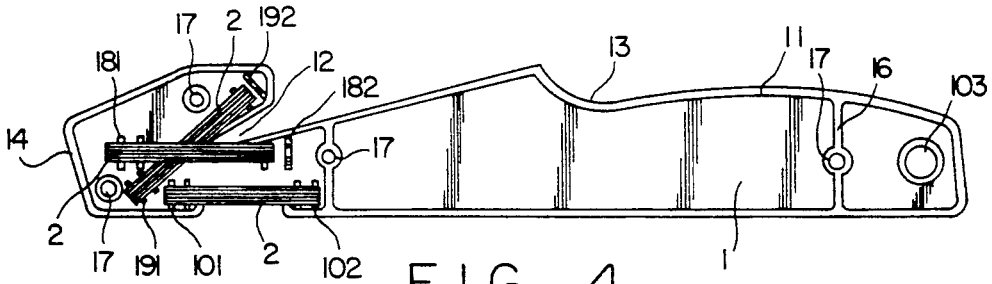
FIG. 4 is a sectional elevation thereof.

As indicated, the first and second side frames 1 and 1' are symmetrical each of which has the same internal structure. The first side frame 1 is now taken as an example for describing the internal structure thereof. Referring to FIGS. 3 and 4 and seeing FIG. 2 again, the side frame 1 has two sets of retainers 181 and 182; 191 and 192 (as an alternate form, each set of retainers may be incorporated into a unitary, elongated retainer) made on the inner wall surface for holding two abrasive rods 2 in a crossed manner below the bevel slot 12, and another set of retainers 101 and 102 for holding another abrasive rod 2 above the notch 15. Each abrasive rod 2 is made from alloy suitable for sharpening metal knifes, having a plurality of embossed stripes 21 uniformly made on the outer surface thereon along longitudinal direction. The retainers 181 and 182; 191 and 192; 101 and 102 of either side frame 1 or 1' each has a coarse surface portion corresponding to the embossed stripes 21 on each abrasive rod 2 which increases friction force and can firmly retain the corresponding abrasive rod 2 in position. The angular position of each abrasive rod 2 in each set of retainers can be adjusted to provide new grinding surface for grinding or, each abrasive rod 2 may be inverted once it is worn at one end.

Figure 5:
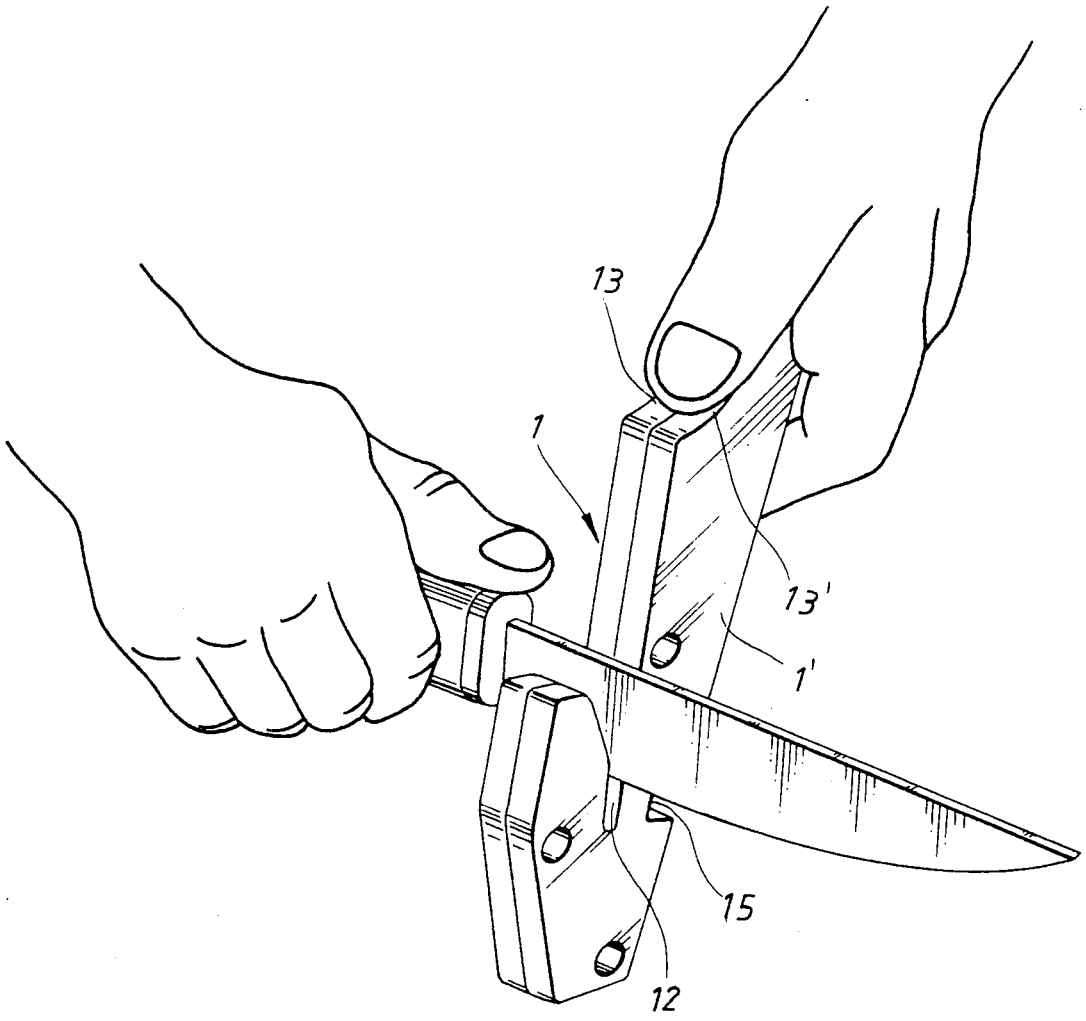
FIG. 5 illustrates an operational example in holding the sharpener for sharpening a knife.
Figure 6:
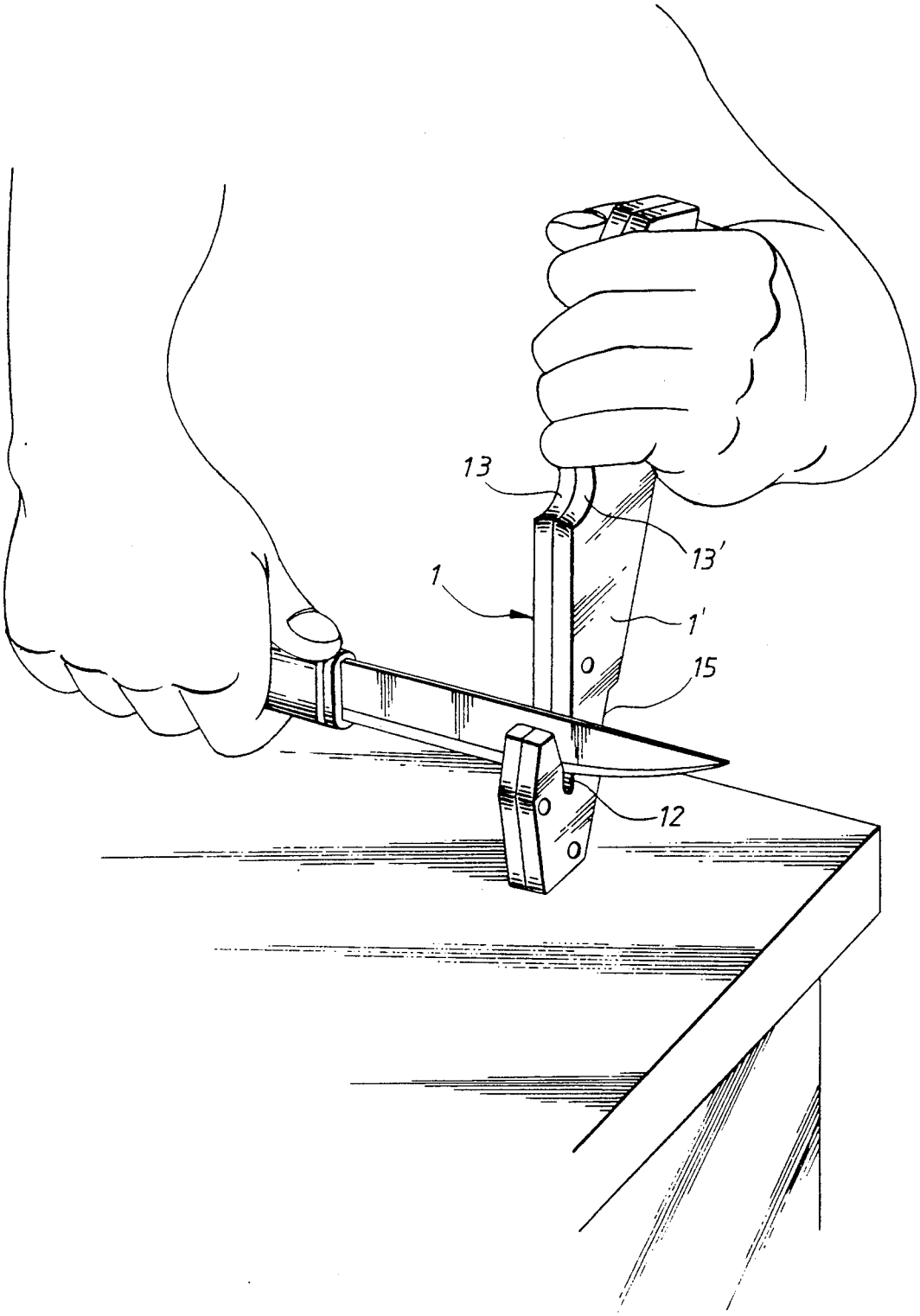
FIG. 6 illustrates another operational example in holding the sharpener for sharpening a knife.

Once the two side frames 1 and 1' are connected together, the curved surface portions 13 and 13' are incorporated into a hand-hold for comfortable and positive grip and, the bevel slots 12 and 12' are incorporated into a supporting surface edge guide for supporting and guiding the knife to be sharpened. During knife sharpening operation, the sharp edge of the knife under sharpening is moved in the direction opposed to the operator (see FIGS. 5 and 6), and therefore, the knife sharpener is very safe in use. Because the supporting surface edge guide of the bevel slots 12 and 12' is disposed at right angle relative to the sloping surface portions 14 and 14', the sloping surface portions 14 and 14' can be stopped against a work table (or the ground) to facilitate knife sharpening operation. Further, the abrasive rod 2 which is disposed above the notch 15 or 15' on each side frame 1 or 1' is provided for sharpening all kinds of knives and can also be used for removing the burr from the sharp edge of the knife having been sharpened. Therefore, the present invention can be used for sharpening any cutting tool which has a single-sided cutting edge, double-sided cutting edge or toothed cutting edge.

The shape of the hand-hold of the knife sharpener may be variously embodied for comfortable and positive grip. Further, a through-hole 103 may be made on the hand hold of the knife sharpener through which the knife sharpener can be hung. As a modification of the present invention, a small can opener or hand tool may be attached to the hand-hold to widen the application of the present invention.

What is claimed is:

1. A knife sharpener comprising two symmetrical side frames, each of which has a plurality of ribs and bolt holes connected to each other, said frames being secured in place by screws to provide a hollow interior, a plurality of abrasive rods non-rotatably fastened by retainer means inside said side frames in crossed position at a predetermined angle for sharpening cutting tools moving back and forth in contact with said rods, said side frames each having a peripheral edge in alignment with the other, to form a relatively wide curved surface portion for comfortable and positive grip and a bevel slot extending angularly toward one end of the aligned side frames away from the curved surface portion for supporting and guiding a knife to be sharpened, said one end is disposed at a right angle relative to the bevel slot and can be stopped against ground surface or work table to facilitate knife sharpening operation.

2. The knife sharpener as set forth in claim 1, wherein said side frames each includes a notch along a peripheral edge opposite to the bevel slot, and a set of retainer means within the frames to hold an abrasive rod parallel within said notch.

* * * * *